United States Patent [19]

Miyaji et al.

[11] Patent Number: 4,559,642

[45] Date of Patent: Dec. 17, 1985

[54] PHASED-ARRAY SOUND PICKUP APPARATUS

[75] Inventors: Naotaka Miyaji, Yamato; Atsushi Sakamoto; Makoto Iwahara, both of Sagamihara, all of Japan

[73] Assignee: Victor Company of Japan, Limited, Yokohama, Japan

[21] Appl. No.: 524,777

[22] Filed: Aug. 19, 1983

[30] Foreign Application Priority Data

Aug. 27, 1982 [JP] Japan ..... 57-148883

[51] Int. Cl.[4] ..... H04R 1/20; H04R 1/40

[52] U.S. Cl. ..... 381/92; 179/121 D; 340/709; 340/713; 340/720; 340/724; 358/108; 367/129; 381/122

[58] Field of Search ..... 381/92, 26, 82, 111, 381/112, 113, 114, 122; 358/108; 179/121 D; 340/709, 713, 720, 724; 367/118, 122, 123, 124–127, 129

[56] References Cited

U.S. PATENT DOCUMENTS

| | | | |
|---|---|---|---|
| 2,896,189 | 6/1959 | Wiggins | 367/123 |
| 3,859,621 | 1/1975 | Foreman | 367/127 |
| 4,311,874 | 1/1982 | Wallace, Jr. | 381/92 |
| 4,421,957 | 12/1983 | Wallace, Jr. | 179/121 D |
| 4,455,630 | 6/1984 | Loonen | 367/123 |

FOREIGN PATENT DOCUMENTS

| | | | |
|---|---|---|---|
| 348606 | 2/1979 | Austria . | |
| 836956 | 5/1952 | Fed. Rep. of Germany . | |
| 867969 | 2/1953 | Fed. Rep. of Germany . | |
| 1067065 | 3/1960 | Fed. Rep. of Germany . | |
| 1277717 | 9/1968 | Fed. Rep. of Germany . | |
| 3021449 | 12/1981 | Fed. Rep. of Germany . | |
| WO82/00061 | 1/1982 | PCT Int'l Appl. . | |
| 578729 | 7/1946 | United Kingdom | 367/126 |

*Primary Examiner*—Gene Z. Rubinson
*Assistant Examiner*—Daneta R. Byrd
*Attorney, Agent, or Firm*—Cushman, Darby & Cushman

[57] ABSTRACT

A phased-array sound pickup apparatus has an array of directional microphones having individual directivity patterns equally oriented in a given direction. The directivity patterns of the microphones combine into the main lobe of the array. A plurality of variable delay circuits are connected to be responsive respectively to individual signals from the microphones for providing incremental delays to the individual signals and combining the delayed signals for delivery as an output of the apparatus. A delay control circuit is coupled to the variable delay circuits for generating a delay control signal for controlling the amount of the incremental delays to cause the main lobe to be steered at an angle to the given direction as a function of the delay control signal.

15 Claims, 5 Drawing Figures

FIG. 4

| STEERING ANGLE (DEGREES) | A/D OUTPUTS (DECIMAL) | SW CONT. | DELAY CONTROL DATA | | | | CURSOR CONTROL DATA (DECIMAL) |
|---|---|---|---|---|---|---|---|
| 67 ~ 90 | 224 ~ 255 | 0 | 1 | 1 | 1 | 1 | – |
| 60 ~ 66 | 214 ~ 223 | 0 | 1 | 1 | 1 | 0 | – |
| 54 ~ 59 | 205 ~ 213 | 0 | 1 | 1 | 0 | 1 | – |
| 48 ~ 53 | 197 ~ 204 | 0 | 1 | 1 | 0 | 0 | – |
| 43 ~ 47 | 190 ~ 196 | 0 | 1 | 0 | 1 | 1 | 218 |
| 38 ~ 42 | 183 ~ 189 | 0 | 1 | 0 | 1 | 0 | 208 |
| 34 ~ 37 | 177 ~ 182 | 0 | 1 | 0 | 0 | 1 | 198 |
| 30 ~ 33 | 171 ~ 176 | 0 | 1 | 0 | 0 | 0 | 190 |
| 20 ~ 29 | 165 ~ 170 | 0 | 0 | 1 | 1 | 1 | 182 |
| 22 ~ 25 | 160 ~ 164 | 0 | 0 | 1 | 1 | 0 | 174 |
| 18 ~ 21 | 154 ~ 159 | 0 | 0 | 1 | 0 | 1 | 166 |
| 14 ~ 17 | 148 ~ 153 | 0 | 0 | 1 | 0 | 0 | 158 |
| 10 ~ 13 | 143 ~ 147 | 0 | 0 | 0 | 1 | 1 | 150 |
| 6 ~ 9 | 137 ~ 142 | 0 | 0 | 0 | 1 | 0 | 142 |
| 3 ~ 5 | 133 ~ 136 | 0 | 0 | 0 | 0 | 1 | 136 |
| 1 ~ 2 | 129 ~ 132 | 0 | 0 | 0 | 0 | 0 | 132 |
| 0 ~ 2 | 125 ~ 128 | 1 | 0 | 0 | 0 | 0 | 124 |
| 3 ~ 5 | 121 ~ 124 | 1 | 0 | 0 | 0 | 1 | 120 |
| 6 ~ 9 | 115 ~ 120 | 1 | 0 | 0 | 1 | 0 | 114 |
| 10 ~ 13 | 110 ~ 114 | 1 | 0 | 0 | 1 | 1 | 106 |
| 14 ~ 17 | 104 ~ 109 | 1 | 0 | 1 | 0 | 0 | 98 |
| 18 ~ 21 | 98 ~ 103 | 1 | 0 | 1 | 0 | 1 | 90 |
| 22 ~ 25 | 93 ~ 97 | 1 | 0 | 1 | 1 | 0 | 82 |
| 26 ~ 29 | 87 ~ 92 | 1 | 0 | 1 | 1 | 1 | 74 |
| 30 ~ 33 | 81 ~ 86 | 1 | 1 | 0 | 0 | 0 | 66 |
| 34 ~ 37 | 75 ~ 80 | 1 | 1 | 0 | 0 | 1 | 58 |
| 38 ~ 42 | 68 ~ 74 | 1 | 1 | 0 | 1 | 0 | 48 |
| 43 ~ 47 | 61 ~ 67 | 1 | 1 | 0 | 1 | 1 | 38 |
| 48 ~ 53 | 53 ~ 60 | 1 | 1 | 1 | 0 | 0 | – |
| 54 ~ 59 | 44 ~ 52 | 1 | 1 | 1 | 0 | 1 | – |
| 60 ~ 66 | 34 ~ 43 | 1 | 1 | 1 | 1 | 0 | – |
| 67 ~ 90 | 1 ~ 33 | 1 | 1 | 1 | 1 | 1 | – |

PHASED-ARRAY SOUND PICKUP APPARATUS

BACKGROUND OF THE INVENTION

The present invention relates generally to electro-acoustic transducers and more particularly to a phased-array sound pickup apparatus having a sharp directivity pattern which can be electronically steered with a high degree of precision.

High directivity microphones are extensively used in various applications where the particular sound source must be correctly pinpointed. Under certain circumstances it is highly desirable that the microphone remain stationary while its direction of sensivity be steered to a desired sound source.

SUMMARY OF THE INVENTION

It is therefore an object of the invention to provide a sound pickup apparatus having a sharp directivity pattern that is electronically steerable with a high degree of precision.

The invention provides a phased-array sound pickup apparatus which comprises an array of directional microphones having individual directivity patterns equally oriented in a given direction. The directivity patterns of the microphones combine into the main lobe of the array. A plurality of variable delay circuits are connected to be responsive respectively to individual signals from the microphones for providing incremental delays to the individual signals and combining the delayed signals for delivery as an output of the pickup apparatus. A delay control circuit is coupled to the variable delay circuits for generating a delay control signal for controlling the amount of the incremental delays to cause the main lobe to be steered at an angle to the given direction as a function of the delay control signal.

Preferably included is a television camera mounted on the microphone array to derive a video output signal from a field of view covering a range of angles in which the main lobe can be steered. A television monitor is coupled to the television camera to provide a display of the video signal on a monitor screen which may be located remotely from the microphone array. A cursor generator is responsive to the delay control signal to generate a display of a cursor on the monitor screen to indicate the position of the main lobe.

BRIEF DESCRIPTION OF THE DRAWINGS

The present invention will be described in further detail with reference to the accompanying drawings, in which:

FIG. 4 is an illustration of delay control data and cursor control data in relation to steering angles.

DETAILED DESCRIPTION

Figure 1:
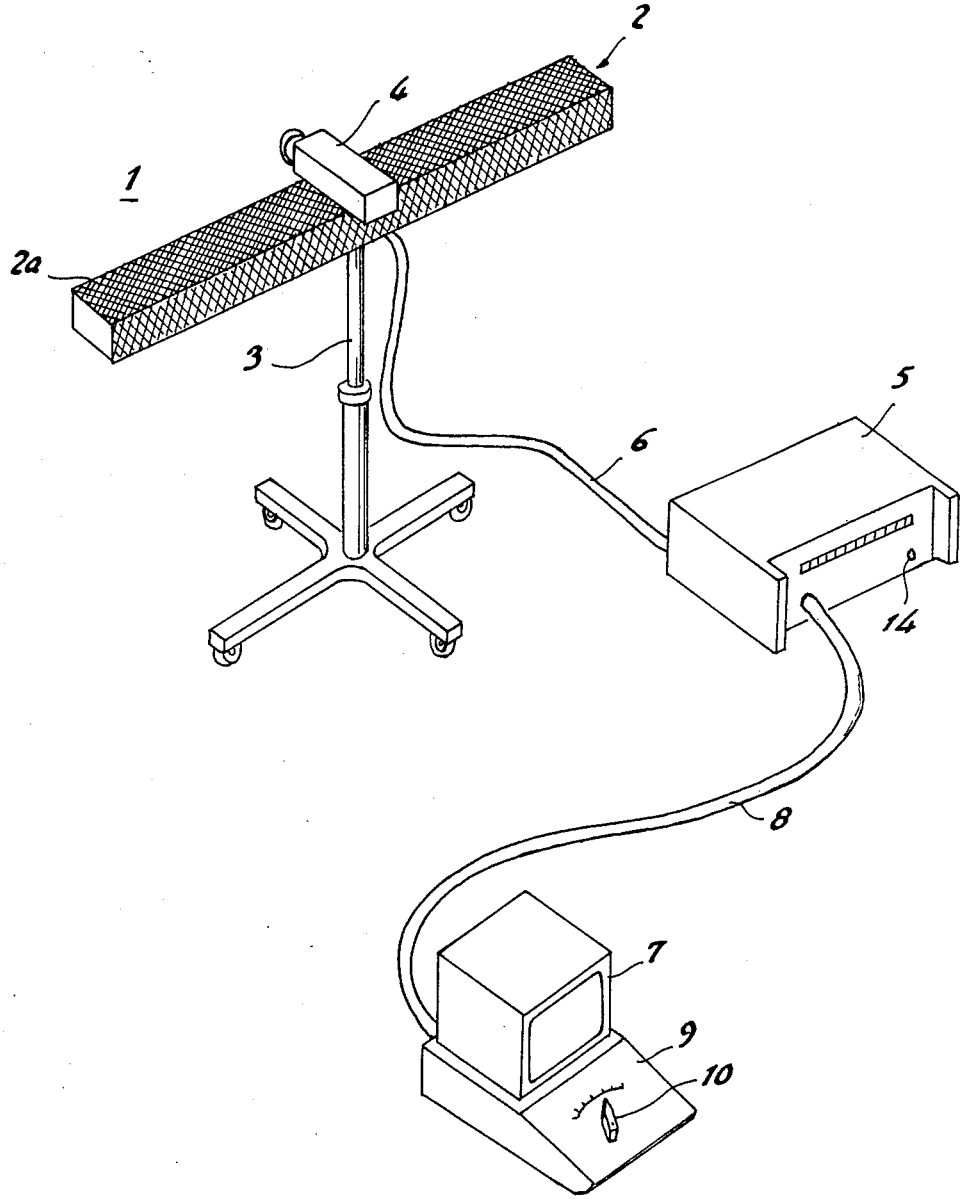
FIG. 1 is an illustration of a phased-array sound pickup apparatus according to the invention.

A phased-array sound pickup system of the present invention is schematically illustrated in FIG. 1. The system generally comprises a remote-controlled microphone apparatus 1 including a microphone unit 2 mounted on a movable support 3 and a television camera 4 mounted on the microphone unit 2. The microphone unit 2 is covered with a mesh 2a to minimize the effect of its presence on the propagation of sound waves. An electronic control unit 5 is coupled to the microphone unit 2 and television camera 4 by means of a cable 6. A television monitor 7 is further provided which is coupled by a cable 8 to the control unit 5. The television monitor 7 is placed on a console 9 having a steering potentiometer 10.

Figure 2:
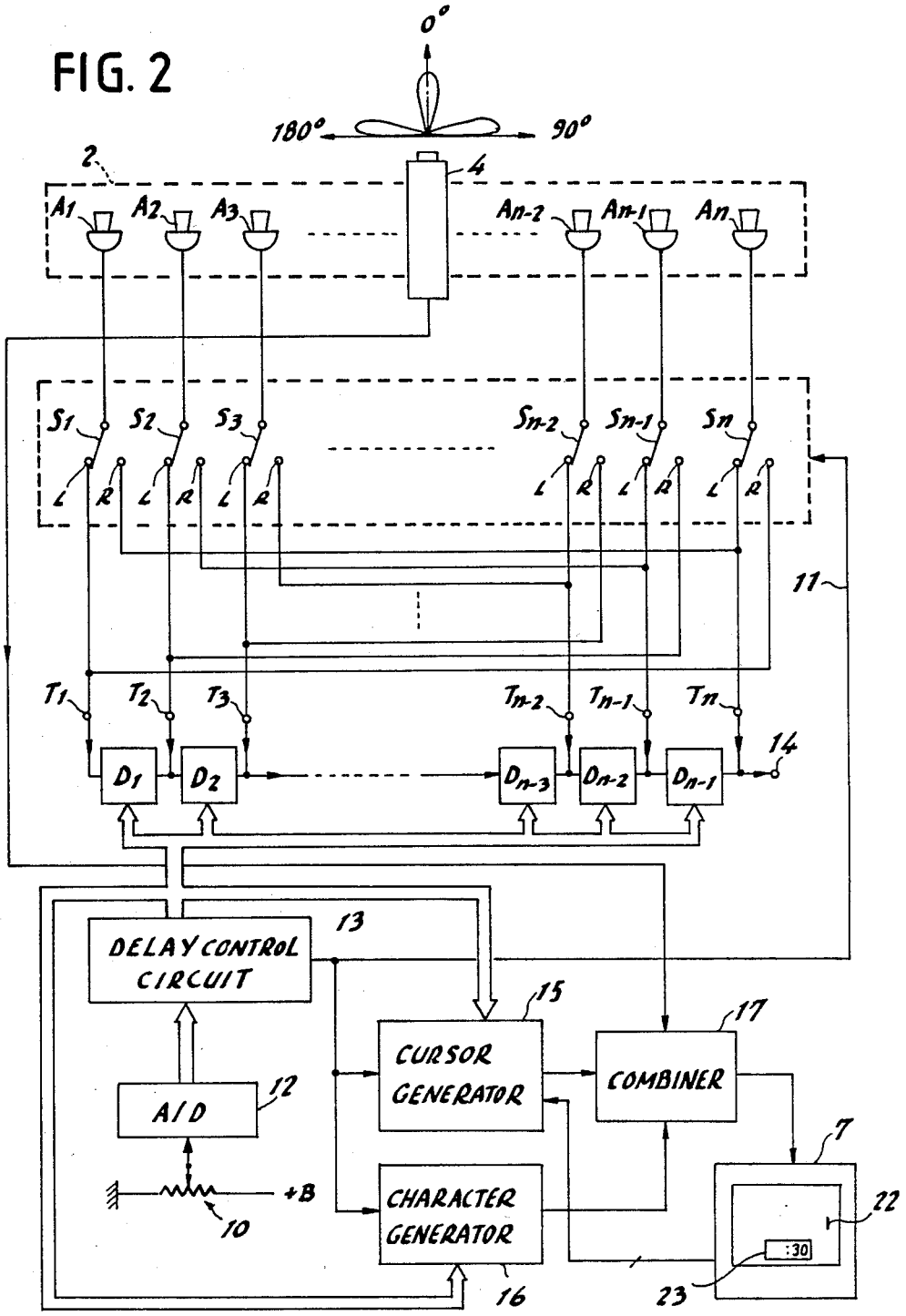
FIG. 2 is a block diagram of the phased-array sound pickup apparatus.

As illustrated in FIG. 2, the microphone unit 2 comprises a linear array of microphones $A_1$ to $A_n$ which are equally spaced apart along the length of the array. Each of the microphones has its directivity pattern oriented in a direction perpendicular to the length of the array.

The control unit 5 includes a plurality of switches $S_1$ to $S_n$ and a tapped delay line formed by a plurality of series-connected 4-bit delay circuits $D_1$ to $D_{n-1}$ having taps $T_1$ to $T_n$. The tap T1 is connected to the input of delay circuit D1 and the tap Tn to the output of delay circuit $D_{n-1}$, the taps $T_2$ to $T_{n-1}$ being connected to the junctions between successive delay circuits respectively. Each of the switches has a moving contact which is selectively coupled to one of rightside and leftside terminals R and L in response to a switching control signal applied on a line 11. The leftside terminals L of the switches $S_1$ to $S_n$ are connected to the taps $T_1$ to $T_n$, respectively and the rightside terminals R of the switches $S_1$ to $S_n$ are connected to the taps $T_n$ to $T_1$, respectively.

The steering potentiometer 10 is coupled between a DC voltage supply and ground to generate an adjusted voltage to an analog-to-digital converter 12. The A/D converter 12 translates the voltage signal into an 8-bit digital code so that it represents the voltage signal with a resolution of 256 discrete values. The 8-bit steering code is applied to a digital delay control circuit 13 where the 8-bit code is converted into a 4-bit delay control signal for coupling to the delay circuits $D_1$ to $D_{n-1}$ and a 1 bit switching control signal for coupling to the switches $S_1$ to $S_n$.

Figure 3:
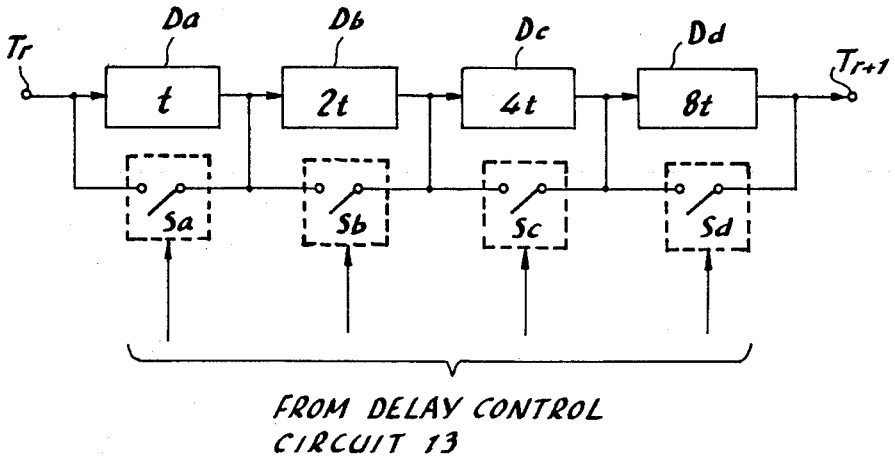
FIG. 3 is an illustration of the detail of the digital delay circuit of FIG. 2.

As shown in FIG. 3, each delay circuit comprises four delay elements Da, Db, Dc and Dd having delay times t, 2t, 4t and 8t (where t represents a unit delay time) and switches Sa, Sb, Sc and Sd. The delay elements Da to Dd are connected in series between adjacent taps $T_r$ and $T_{r+1}$ and short-circuited by switches Sa to Sd, respectively, in response to the individual bit positions of the 4-bit delay control signal.

The delay times of the circuits $D_1$ to $D_{n-1}$ are simultaneously controlled by the 4-bit delay control signal in a range of 16 discrete steps. With all the switches $S_1$ to $S_n$ being positioned to the leftside terminals and all the delay circuits being adjusted to a given delay time, the signal detected by microphone $A_1$ passes through all the delay circuits, the signal from microphone $A_2$ passes through delay circuits $D_2$ to $D_{n-1}$, and the signal from microphone $A_n$ is directly applied to an output terminal 14. Thus, the signal from the microphone $A_1$ undergoes a maximum delay while the signal from the microphone $A_n$ undergoes a minimum delay. When all the switches $S_1$ to $S_n$ are switched to the rightside terminals, the signal from microphone $A_1$ undergoes a minimum delay and the signal from microphone $A_n$ undergoes a maximum delay. Thus, the signals from the microphones $A_1$ to $A_n$ are delayed in incremental amounts and combined at the terminal 14 in a desired phase relationship determined by the amount of incremental delay introduced to each delay circuit. When the total delay is zero, the overall directivity of the microphone array 2, known as the main lobe, is oriented in a refererence direction which is perpendicular to the length of the array 2 and is taken to be a zero angle position.

With the switches being positioned in the leftside terminals, a variation of the incremental delay from zero causes the main lobe to be angulated counterclockwise from the zero angle position to a 90-degree point therefrom. Conversely, with the switches being positioned in the rightside terminals, a variation of the incremental delay from zero causes the main lobe to be angulated clockwise from the zero angle position to a 90-degree point therefrom, providing a total of 180-degree steering of the main lobe.

In a practical embodiment of the invention, the steering angle of the main lobe is divided into 16 increments on each side of the zero angle position to which are assigned 16 groups of 8-bit codes which are in turn represented by the 4-bit delay signal, as illustrated in FIG. 4. The binary state of the switching control signal is "0" when steering to the left and "1" when steering to the right.

Figure 5:
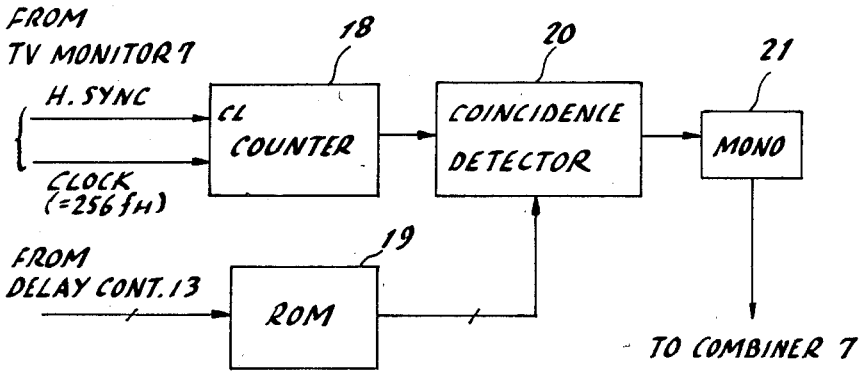
FIG. 5 is an illustration of the detail of the cursor generator of FIG. 1.

In order to facilitate precision steering of the main lobe, the apparatus includes a cursos generator 15, a character generator 16 and a combiner 17. As shown in FIG. 5, the cursor generator 15 comprises a binary counter 18 which counts clock pulses supplied from the television monitor 7 to generate a binary output which is reset to zero in response to a horizontal sync pulse also supplied from the monitor 7. A read only memory 19 stores cursor control data shown in FIG. 4 in locations addressable as a function of the 4-bit delay control signal and 1-bit switching control signal. A coincidence detector 20 compares the binary output of counter 18 against the data read out of the memory 19 to detect a match therebetween. A monostable multivibrator 21 is coupled to the output of the coincidence detector 20 to generate a cursor pulse. The repetition frequency of the clock pulse supplied to the counter 18 is 256 times as high as the horizontal sync.

The character generator 16 is an integrated circuit of the type MM5840 (available from National Semiconductor) which is currently employed as a TV channel number and time display circuit. The character generator 16 is in receipt of the 4-bit delay signal and 1-bit switching signal from the delay control circuit 13 and generates a binary signal indicating the angular position of the cursor.

The cursor pulse and the character-bearing signal are combined in the combiner 17 with a video signal from the television camera 4 and supplied to the television monitor 7 so that the cursor is made to appear on the monitor screen as a small vertical line, as shown at 22 in FIG. 2, in one of 24 positions along a given horizontal line. The television camera 4 has a field of view substantially covering the range of 43-degrees on each side of the zero angle position. Being generated as a function of the same delay control signal as that applied to the tapped delay line, the cursor indicates the direction in which the main lobe is directed. The angular position is indicated in number on the monitor screen as shown at 23 in FIG. 2.

With the aid of the cursor and numerical angular position data, the main lobe of the microphone apparatus of the invention can be easily steered to a desired sound source with a high degree of precision.

What is claimed is:

1. A phased-array sound pickup apparatus comprising:

an array of directional microphones having individual directivity patterns equally oriented in a given direction, said directivity patterns resulting in a main lobe, each microphone providing a signal;

a plurality of digitally controlled variable delay circuits respectively connected to said array of microphones and responsive to individual signals from said microphones, for introducing incremental delays to said individual signals and combining the delayed signals for delivery as an output of said pickup apparatus; and control signal generating means, coupled to said variable delay circuits, for generating a digital delay control signal to control the amount of said incremental delays to cause said main lobe to be steered at an angle to said given direction as a function of said control signal, said control signal generating means including means for generating an adjustable DC voltage, and means for converting said DC voltage into a binary code.

2. A phased-array sound pickup apparatus as claimed in claim 1, further including switching means for providing reversals in connections between said microphones and said variable delay circuits so that the signal from the microphone located at one end of said array is given a maximum amount of incremental delay when said switching means is in a first switched condition and a minimum amount of incremental delay when said switching means is in a second switched condition so that said main lobe is steered on either side of said given direction.

3. A phased-array sound pickup apparatus as claimed in claim 2, wherein said delay circuits include a tapped delay line having a plurality of taps between successive delay circuits, said taps being connected respectively to said microphones through said switching means.

4. A phased-array sound pickup apparatus as claimed in claim 3, wherein said switching means includes a plurality of switches respectively connecting said microphones to said delay circuits through first terminals during said first switched condition and through second terminals during said second switched condition, and wherein said control signal generating means includes means for generating a switching control signal for causing said switches to switch between said first and second terminals.

5. A phased-array sound pickup apparatus as claimed in claim 4, wherein said binary code has a plurality of binary digits including a first portion representing said delay control signal and a second portion representing said switching control signal.

6. A phased-array sound pickup apparatus as claimed in claim 1, further including: a television camera mounted on said microphone array for deriving a video signal from a field of view covering a range of angles in which said main lobe can be steered; display means coupled to said television camera for generating a display of said video signal on a monitor screen; and means for indicating the position of said main lobe on said monitor screen.

7. A phased-array sound pickup apparatus as claimed in claim 6, wherein said indicating means includes means for generating a display of a cursor on said monitor screen in response to said delay control signal.

8. A phased-array sound pickup apparatus as claimed in claim 6, wherein said indicating means includes means for generating a display of an angular position indicating number on said monitor screen in response to said delay control signal.

9. A phased-array sound pickup apparatus as claimed in claim 7, wherein said indicating means includes means for generating a display of an angular position indicating number on said monitor screen in response to said delay control signal.

10. A phased-array sound pickup apparatus as claimed in claim 5, further including: a television camera mounted on said microphone array for deriving a video signal from a field of view covering a range of angles in which said main lobe can be steered; display means coupled to said television camera for generating a display of said video signal on said monitor screen; and means for indicating the position of said main lobe on said monitor screen.

11. A phased-array sound pickup apparatus as claimed in claim 10, wherein said indicating means comprises means for generating a display of a cursor on said monitor screen in response to said binary code.

12. A phased-array sound pickup apparatus as claimed in claim 10, wherein said indicating means includes means for generating a display of an angular position indicating number on said monitor screen in response to said binary code.

13. A phased-array sound pickup apparatus as claimed in claim 12, wherein said indicating means includes means for generating a display of an angular position indicating number on said monitor screen in response to said binary code.

14. A phased-array sound pickup apparatus comprising:

an array of directional microphones having equally oriented individual directivity patterns, said directivity patterns resulting in a main lobe, each microphone producing a signal;

a plurality of switches respectively, connected to said microphones;

a tapped delay line including a plurality of digitally controlled variable delay circuits and taps provided between successive delay circuits, said taps being connected respectively to said microphones through said switches for introducing incremental delays to individual signals from said microphones so that the signal from the microphone located at one end of the array is given a maximum incremental delay when said switches are in a first switched condition, causing said main lobe to be steered on one side of a reference, and a minimum incremental delay when the switches are in a second switched condition, causing said main lobe to be steered on another side of said reference, said digitally controlled variable delay circuits and taps combining the delayed signals for generating an output of said pickup apparatus; and means, coupled to said variable delay circuits and to said switches, for generating (a) a delay control signal to control the amount of said incremental delays and (b) a switching control signal for causing said switches to be switched in one of said first and second switched conditions, said generating means including means for generating an adjustable DC voltage and means for converting said voltage into a binary code having a plurality of binary digits including a first portion representing said delay control signal and a second portion representing said switching control signal.

15. A phased-array sound pickup apparatus comprising:

an array of directional microphones having individual directivity patterns equally oriented in a given direction, said directivity patterns resulting in a main lobe, each microphone providing a signal;

a plurality of digitally controlled variable delay circuits respectively connected to said array of microphones and responsive to individual signals from said microphones, for introducing incremental delays to said individual signals and combining the delayed signals for delivery as an output of said apparatus;

means coupled to said variable delay circuits for generating a digital delay control signal to control the amount of said incremental delays to cause said main lobe to be steered at an angle to said given direction as a function of said control signal, said generating means including means for generating an adjustable DC voltage, and means for converting said DC voltage to binary code;

a television camera mounted on said microphone array for deriving a video signal from a field of view covering a range of angles in which said main lobe is steered;

display means coupled to said television camera for generating a display of said video signal on a monitor screen; and means for indicating the position of said main lobe on said monitor screen.

* * * * *